United States Patent [19]

Ross et al.

[11] Patent Number: 4,738,105

[45] Date of Patent: Apr. 19, 1988

[54] COMPACT CRANK DRIVE MECHANISM WITH GUIDED PISTONS

[76] Inventors: M. Andrew Ross, 4195 Mumford Ct., Columbus, Ohio 43220; William T. Beale, Rte. 6, Box 73, Athens, Ohio 45701

[21] Appl. No.: 17,822

[22] Filed: Feb. 24, 1987

[51] Int. Cl.[4] ..... F02G 1/04

[52] U.S. Cl. ..... 60/517; 74/44

[58] Field of Search ..... 60/517, 525; 74/44, 74/45

[56] References Cited

U.S. PATENT DOCUMENTS 4,138,897 2/1979 Ross ..... 74/44 X 4,532,819 8/1985 Ross ..... 60/525 X 4,546,663 10/1985 Wood ..... 74/44

*Primary Examiner*—Allen M. Ostrager

*Attorney, Agent, or Firm*—Frank H. Foster

[57] ABSTRACT

A crank drive mechanism for the two-piston Stirling engine which reduces engine size, cost and complexity, while increasing mechanical efficiency. A single throw crankshaft is located in a housing below two cylinders. A triangular yoke connects the single crankpin with two guided pistons which operate in these cylinders. A rocking lever connects the yoke with the engine housing and absorbs any side loads associated with the crank drive mechanism. Extensive crankcase space provided by the guided pistons permits the engine parts to be arranged in a very compact manner with ample running clearance.

4 Claims, 1 Drawing Sheet

COMPACT CRANK DRIVE MECHANISM WITH GUIDED PISTONS

TECHNICAL FIELD

This invention provides a simple and practical method to reduce the size, cost and complexity of a single-acting two-piston Stirling engine, while at the same time increasing its mechanical efficiency.

BACKGROUND ART

It is generally agreed that the single-acting two piston Stirling engine is one of the most desirable forms of Stirling for small power applications, having demonstrated both simplicity and good performance. Such engines may be designed in a variety of forms; for example, cylinders may be in a V, in-line, or horizontally opposed arrangement.

One of the most desirable arrangements is the inverted yoke drive described by Ross in U.S. Pat. No. 4,532,819. In this design the upper apex of a triangular yoke is attached to a single-throw crankshaft located beneath twin parallel cylinders. The lower portion of the yoke is constrained by a rocking lever. The lower apexes of the yoke are attached by connecting rods to the respective pistons. Practically all of the side loads encountered in this mechanism are absorbed by the rocking lever bearings. The pistons themselves see very low side loads, and therefore they may be run without liquid lubrication, yet still give long life with low friction losses. The ability to run well without liquid lubrication is an important advantage in a Stirling engine.

Inverted yoke drive Stirling engines have in fact demonstrated excellent mechanical efficiency, and their overall size and weight are considerably less than that of two-piston engines of other configurations, for a given presure level and power.

The aim of this invention is to disclose a new form of yoke-based crank drive mechanism for the two-piston Stirling which offers a considerable reduction of cost, complexity, and reciprocating weight in a given engine, and yet retains all the known advantages of the previous inverted yoke drive mechanism.

Other aims, features, and advantages will be apparent in the description below.

BRIEF DISCLOSURE OF INVENTION

This invention is a crank drive mechanism for a two-piston Stirling engine that greatly decreases engine size, weight, cost and complexity by combining the drive mechanism and the pistons in the same compact volume.

In one example, a crankshaft is mounted in a crankcase housing below two vertical parallel cylinders. A yoke of three arms, in the shape of an inverted "T" is connected on its vertical arm to the single throw of the crankshaft. The other two arms of the yoke extend horizontally beneath the respective cylinders. In each cylinder operates a disc-shaped piston with an integral piston rod extending beneath it. In accordance with their functions, one piston is called the compression piston, and the other the expansion piston. Each piston is attached by its piston rod to the yoke arm beneath it. A rocking lever, attached at one end to the yoke at the intersection of the yoke arms, and at its other end to the crankcase housing, guides the lower portion of the yoke and absorbs the crank-induced side loads. The lower portion of each piston is guided by its yoke arm in a nearly linear reciprocating path along the axis of its cylinder. The upper portion of each piston is guided by its cylinder.

Figure 1:
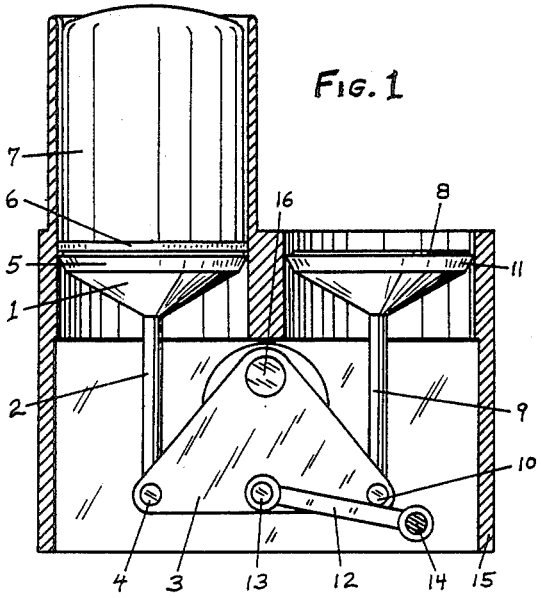
FIG. 1 is a schematic side view of the crank drive mechanism constructed in accordance with this invention with the crankpin at its top position.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

This invention is a crank drive mechanism for the single-acting two-piston Stirling engine. In one example of such a mechanism two vertical, parallel cylinders are incorporated in a housing. A crankshaft bore intersects these cylinders transverse to the plane of their axes, at about the midpoint of their height. The portion of these cylinders extending above the crankshaft bore is left intact, since this portion will constitute the sealing surface for the pistons' seals. The portion of the housing between the cylinders extending below the crankshaft bore is relieved to permit assembly and operation of a yoke and rocking lever.

The yoke in this example has the form of a triangle, with two of its three apexes extending opposite each other horizontally, and the other apex extending vertically above them. The vertical apex contains the crankpin bearing, while the horizontal apexes contain the piston rod bearing. Located vertically beneath the crankpin bearing, and centrally between the piston rod bearings, is a fourth bearing for the rocking lever. It is well known in the art how changing the relative position of the yoke bearings will change the phasing of the two pistons, so that a wide range of piston phase angles may be chosen with only a slight modification of the yoke geometry.

The compression piston comprises a piston head and self-lubricating seal (such as a cup-type seal) and an integral piston rod which attaches to, and is guided by, the yoke bearing located beneath it. The compression piston head is freely guided by its cylinder, and, because it can be very lightweight, the seal itself can generally provide the necessary guidance. No separate guide ring or other guide means is necessary.

The expansion piston is similar, but, as it must operate in part in the engine's externally heated expansion space, it incorporates a heat insulating dome that extends some distance beyond the sealing portion of the piston. This dome becomes in effect a cantilevered mass above the piston seal, and it is therefore desirable to provide a separate self-lubricated guide ring (or other guide means) to guide the upper portion of the expansion piston in its cylinder. This guide ring should preferably be as close to the sealing face of the seal as possible, so that any deviation from linearity in this piston's reciprocation will affect the sealing as little as possible. If it is located above the seal, the guide ring should be grooved or scalloped to let air freely pass by it, so as not to become a partial seal itself, and thus interfere with the operation of the actual seal. As with the compression piston, the lower portion of the expansion piston is guided by the yoke bearing that operates beneath it.

It is desirable to keep the side clearance between the insulating dome and the walls of the expansion space as small as possible, and therefore it is necessary to keep the expansion piston's motion as close to linear as possible. The yoke-drive mechanism used in this invention will in fact provide nearly linear reciprocating motion in the yoke piston rod bearing extending opposite the rocking lever, if the length between the pin of the relevant bearing and the pin attaching the rocking lever to the yoke is in the range of 0.7 to 1 times the length of the pin to pin center distance of the rocking lever.

In practical engines it is possible to reduce oscillation of the domed expansion piston to ±0.2 degrees. Of course, as the motion of one yoke piston rod bearing is made more linear, the opposite yoke bearing motion becomes less so; but even then, in practical engines it is possible to keep compression piston oscillation below ±1 degrees.

It is not enough that the preferred yoke pisotnr od bearing generate nearly linear motion; said bearing (and the yoke that carries it) must also be truly centered in the extended axis of the cylinder it serves. With respect to the location of the yoke along the crankshaft axis, guidance is most easily provided by the rocking lever, which may be readily shimmed or otherwise adjusted along the axis of its pivot pin in the cylinder housing to provide proper centering in this direciton. With respect to the side-to-side positioning of the yoke, close dimensional tolerances held on the location of the relevant bearing holes in the yoke, rocking lever, and cylinder housing will provide the proper centering. Alternatively, means of slightly adjusting the effective length of the rocking lever, or the position of the piston rod relative to the piston face, which will be apparent to those familiar with the art, may be employed to assure proper centering.

In assembly, the yoke, with the rocking lever and pisotns attached, is inserted into the bottom of the cylinder housing through the relieved portion between the cylinders and into the crankshaft bore. At the same time, the pistons are guided into their respective cylinders. The crankshaft is then inserted in the crankshaft bore and through the crankpin bearing in the yoke. The free end of the rocking lever is then engaged with a shaft inserted transversely through the bottom of the cylinder housing. This operation completes the basic crank drive assembly. The addition of a heater, regenerator, and cooler will make this machine a Stirling engine.

The invention will be more fully explained with reference to the accompanying drawings, which represent an example thereof.

FIG. 1 shows a section side view of the crank drive mechanism. Expansion piston 1 operates in the expansion cylinder and is connected by integral piston rod 2 to yoke 3, at wrist pin 4. Attached to expansion piston 1 is piston seal 5, guide ring 6, and heat insulating dome 7. Compression piston 8 operates in the compression cylinder and is connected by integral piston rod 9 to yoke 3, at wrist pin 10. Seal 11 provides both sealing and guidance for the upper portion of compression piston 8. One end of rocking lever 12 is connected to yoke 3 at pin 13, midway between the wrist pins 4 and 10. The other end of lever 12 is pivoted on a pin 14, fixed to cylinder housing 15. Pin 14 may be placed as close to yoke 3 as possible to give wrist pin 4 as nearly linear a motion as possible. The crankshaft is located between the pistons and within the limits of their reciprocation and it is connected to yoke 3 at crankpin 16. Pistons 1 and 8 and cylinder housing 15 are designed so as to provide running clearance for yoke 3, lever 12, and crankpin 15.

Figure 2:
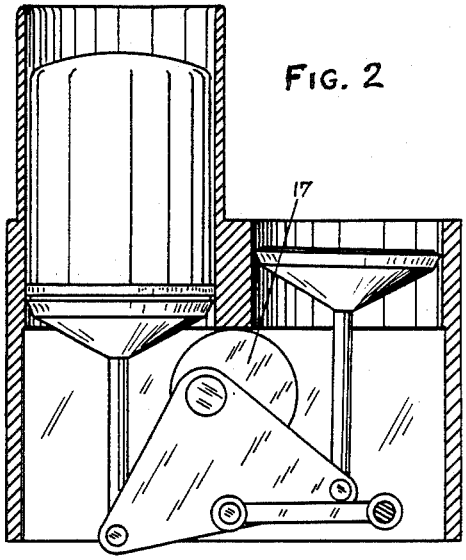
FIG. 2 is the same view of the engine in FIG. 1 with the crankshaft advanced 90 degrees.

FIG. 2 shows the same mechanism during the power stroke, after crankshaft 17 has moved 90 degrees in its direction of travel. Hot piston 1 is about halfway along its expansion stroke, while cool piston 8 is at nearly the same position as in FIG. 1.

Figure 3:
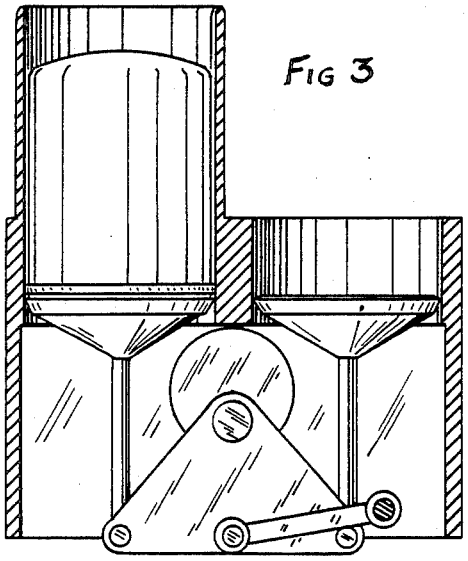
FIG. 3 is the same view of the engine in FIG. 1 with the crankshaft advanced 180 degrees.

FIG. 3 shows the mechamism at its point of maximum volume, with the crankshaft advanced 180 degrees from FIG. 1. While pistons 1 and 8 appear to be in the same position, cool piston 8 is actually moving up, while hot piston 1 is continuing down to complete its expansion stroke.

Figure 4:
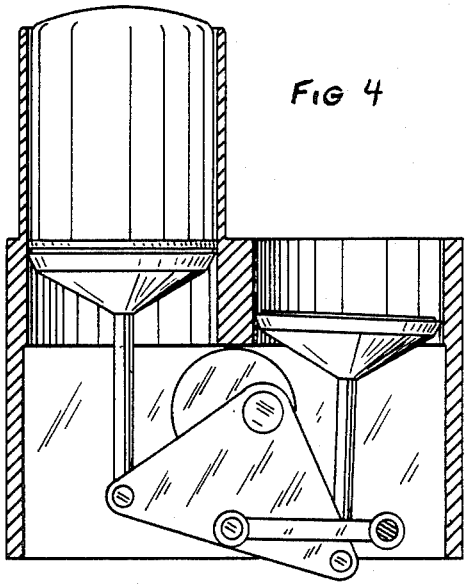
FIG. 4 is the same view of the engine in FIG. 1 with the crankshaft advanced 270 degrees.

FIG. 4 shows the mechanism during its compression stroke, with the crankshaft advanced 270 degrees from its position in FIG. 1.

Figure 5:
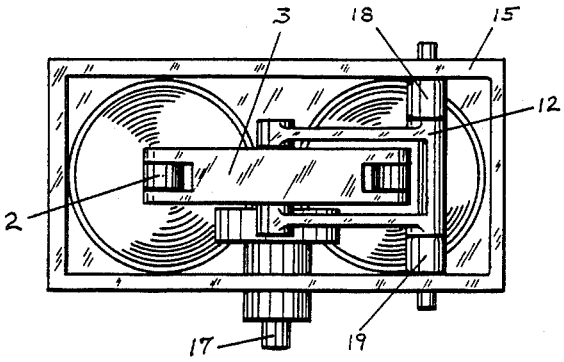
FIG. 5 is a bottom view of the engine as shown in FIG. 3

FIG. 5 shows the bottom view of the mechanism as shown in FIG. 3. Crankshaft 17 may be seen extending out of the cylinder housing 15. Yoke 3 is guided by lever 12 and the centering of both lever 12 and yoke 3 along the axis of crankshaft 17, is provided by spacers 18 and 19.

The principal feature of the present invention is the fact that a first one of the pistons, the expansion piston 6 which has its insulator 7 portion extending substantially into attached piston rod so that it is formed as a first rocker piston. This can be accomplished if the first piston 6 is pivotally connected to the yoke 3 at the pivot axis of the wrist pin 4 which is distal, that is laterally opposite the rocking lever 12. The pivot axis of the wrist pin 4 has substantially no lateral movement and therefore permits a rocker piston 6 to be used in spite of the fact it has its insulator 7 extending far into its cylinder.

The second piston 8 is also a rocker piston having its rigidly attached piston rod 9 pivotally attached to the pivot axis of the wrist pin 10 of the yoke 3. While the wrist pin 10 has a greater lateral movement during operation, such lateral movement can be tolerated by the rocker piston 8 because it does not have the extension substantially up into its cylinder.

The lateral motion of the wrist pin 4 is minimized if the distance from the axis of the pin 13 to the axis of the wrist pin 4 is between 70% and 100% of the length between the pivot axes of the rocking lever pins 13 and 14.

These features are particularly advantageous when the mechanism is used with a Stirling cycle engine in which the first piston 6 is an expansion piston which requires the use of the heat insulating dome portion 7 and the second piston 8 is the compression piston which is cooler and therefore does not require such an insulating extension into the cylinder.

While certain preferred embodiments of the present invention have been disclosed in detail, it is to be understood that various modifications may be adopted without departing from the spirit of the invention or scope of the following claims.

We claim:

1. An improved engine of the type having at least two pistons which reciprocate with a desired phase difference in two adjacent cylinders in a housing and having a crankshaft linked to the pistons by a crank drive mechanism formed by a yoke and a rocking lever, said yoke having a central pair of pivot axes and a pair of laterally distal pivot axes spaced on opposite sides of the central axes and each connected by a connecting rod to a different one of said pistons, one of said central pivot axes being rotatably attached to a throw of the crankshaft, the rocking lever being pivotally attached at one end to the second central pivot axis of the yoke and extending laterally into pivotal attachment with the housing wherein the improvement comprises:

(a) a first one of said pistons having a rigidly attached piston rod to form a first rocker piston which is pivotally connected to the yoke distal pivot axis which is laterally opposite the rocking lever, said first piston having a portion extending substantially into its cylinder; and (b) the second piston being a rocker piston having rigidly attached piston rod pivotally attached to the other yoke distal pivot axis.

2. An engine in accordance withy claim 1 wherein the yoke pivot axis which is connected to said first piston is laterally offset from the yoke pivot axis which is connected to the rocking lever by a distance which is substantially in the range of 0.7 to 1 multiplied by the length between the pivot axes of the rocking lever.

3. An engine in accordance with claim 2 wherein said engine is a Stirling cycle engine and said first piston is its expansion piston and has a heat insulating dome portion.

4. An engine in accordance with claim 1 wherein said engine is a Stirling cycle engine and said first piston is its expansion piston and has a heat insulating dome portion.

* * * * *